US005236093A

United States Patent [19]

Marrs

[11] Patent Number: 5,236,093

[45] Date of Patent: Aug. 17, 1993

[54] RATE CONTROL OVERFLOW SYSTEM FOR DISK SCREENS

[75] Inventor: Gevan R. Marrs, Puyallup, Wash.

[73] Assignee: Weyerhaeuser Company, Tacoma, Wash.

[21] Appl. No.: 975,771

[22] Filed: Nov. 13, 1992

[51] Int. Cl.[5] ..... B07C 5/00

[52] U.S. Cl. ..... 209/552; 209/234; 209/672

[58] Field of Search ..... 209/234, 235, 552, 629, 209/672, 673, 44.1, 1, 243, 244, 246, 910

[56] References Cited

U.S. PATENT DOCUMENTS

| | | | |
|---|---|---|---|
| 4,037,712 | 7/1977 | Wochnowski | 198/524 |
| 4,223,845 | 9/1980 | Selonke et al. | 198/524 X |
| 4,235,248 | 11/1980 | Schumacher | 198/524 X |
| 4,376,042 | 3/1983 | Brown | 209/672 X |
| 4,658,964 | 4/1987 | Williams | 209/552 |
| 4,940,131 | 7/1990 | Swartz | 198/524 |
| 5,078,274 | 1/1992 | Brown | 209/234 X |
| 5,133,507 | 7/1992 | Sepling et al. | 209/234 X |
| 5,137,621 | 8/1992 | Brown | 209/234 |

*Primary Examiner*—D. Glenn Dayoan
*Attorney, Agent, or Firm*—Clark A. Puntigam

[57] ABSTRACT

The system includes a variable speed motor (13) which controls the operation of a disk screen (14) which is part of a gyratory screen/disk screening system for wood chips and the like. Wood chips are fed at a variable rate to a storage bin (34), which includes a level sensor (36). The level sensor (36) controls the operation of a star feeder (42) to maintain the level of providing a varying amount of input material to the upstream end of the gyratory screen (12). The speed of the motor (46) driving the star feeder valve (42) is used to develop a control signal for the disk screen motor (13), to ensure a uniform flow rate off the disk screen.

10 Claims, 1 Drawing Sheet

RATE CONTROL OVERFLOW SYSTEM FOR DISK SCREENS

TECHNICAL FIELD

This invention relates generally to the art of screening systems for wood chips and the like and more particularly concerns a control system for a disk screen portion of a gyratory/disk screen combination system.

BACKGROUND OF THE INVENTION

In a particular screening system for wood chips, comprising a gyratory screen followed by a disk screen, the disk screen is typically operated at a fixed speed. The fixed speed usually is selected to achieve a particular overthick removal efficiency (ORE). There is a practical maximum limit, however, to the overthick removal efficiency, since as ORE is increased, the carry-over of acceptable size wood chips (ACO) off the end of the disk screen also increases, which is undesirable. It is the combination of these two operating characteristics, overthick removal efficiency (ORE) and accepts carry-over (ACO) which determine the overall performance rating of a screening system. As indicated above, while a high ORE is desirable, further increases in ORE beyond a certain point will actually reduce the overall performance of the screening system, due to a more than offsetting increase in ACO. The ACO should be as low as possible. Typically, the disk screen speed is selected only after a period of experimentation with the system and the apparatus is then run at that particular speed thereafter in its operating setting.

In typical operation of the above-described combined screening system, a varying amount of material over time is provided to the input end of the disk screen from the gyratory screen. This changing quantity of mass input material results occasionally in large quantities of material being passed over the disk screen and sent to a follow-on portion of the system, a chip slicer. Large quantities of material at the chip slicer will result in the plugging or breakdown of the slicer, which in turn causes a shutdown of the entire screening system, a very undesirable result.

While it is understood that this mass flow problem can be corrected by reducing the speed of the disk screen to the extent that the slicer is never overtaxed, such a solution will reduce the ORE of the system not only when the mass flow rate is high due to a high feed rate, but also during other feed rates, including a feed rate which would result in a mass flow rate off the end of the disk screen otherwise acceptable to the slicer. While the solution to such a problem would appear to be a variable speed control for the disk screen, such a possibility has not been implemented in practice, because it was not heretofore considered to be feasible to have a feedback control dependent on the mass flow rate of material off the disk screen. For instance, it is desirable that the mass flow rate off the disk screen be relatively uniform. This requires monitoring the flow rate such that as the flow rate begins to increase, feedback control would slow the disk screen down to handle the increased flow and vice versa. However, to date there has been no practical, reliable way to monitor the mass flow rate off the disk screen. Hence, combined gyratory and disk screens have continued to use a fixed disk screen speed even though this does have undesirable consequences relative to overall system operation and efficiency.

DISCLOSURE OF THE INVENTION

Accordingly, the present invention is a system for control of the rate of overflow from a disk screen portion of a combination screening system, which includes: a screening system which includes a first screen assembly, a following disk screen assembly, and a feeder assembly at an input end of said first screen assembly, said feeder assembly adapted to receive input material from a source thereof and including a drive means which in operation provides a variable rate of input material to the input end of said first screen assembly; and control means responsive to the operation of said feeder assembly for variably controlling the speed of the disk screen.

BRIEF DESCRIPTION OF THE DRAWINGS

The figure is a simplified schematic view showing the overall system of the present invention.

BEST MODE FOR CARRYING OUT THE INVENTION

Figure 1:
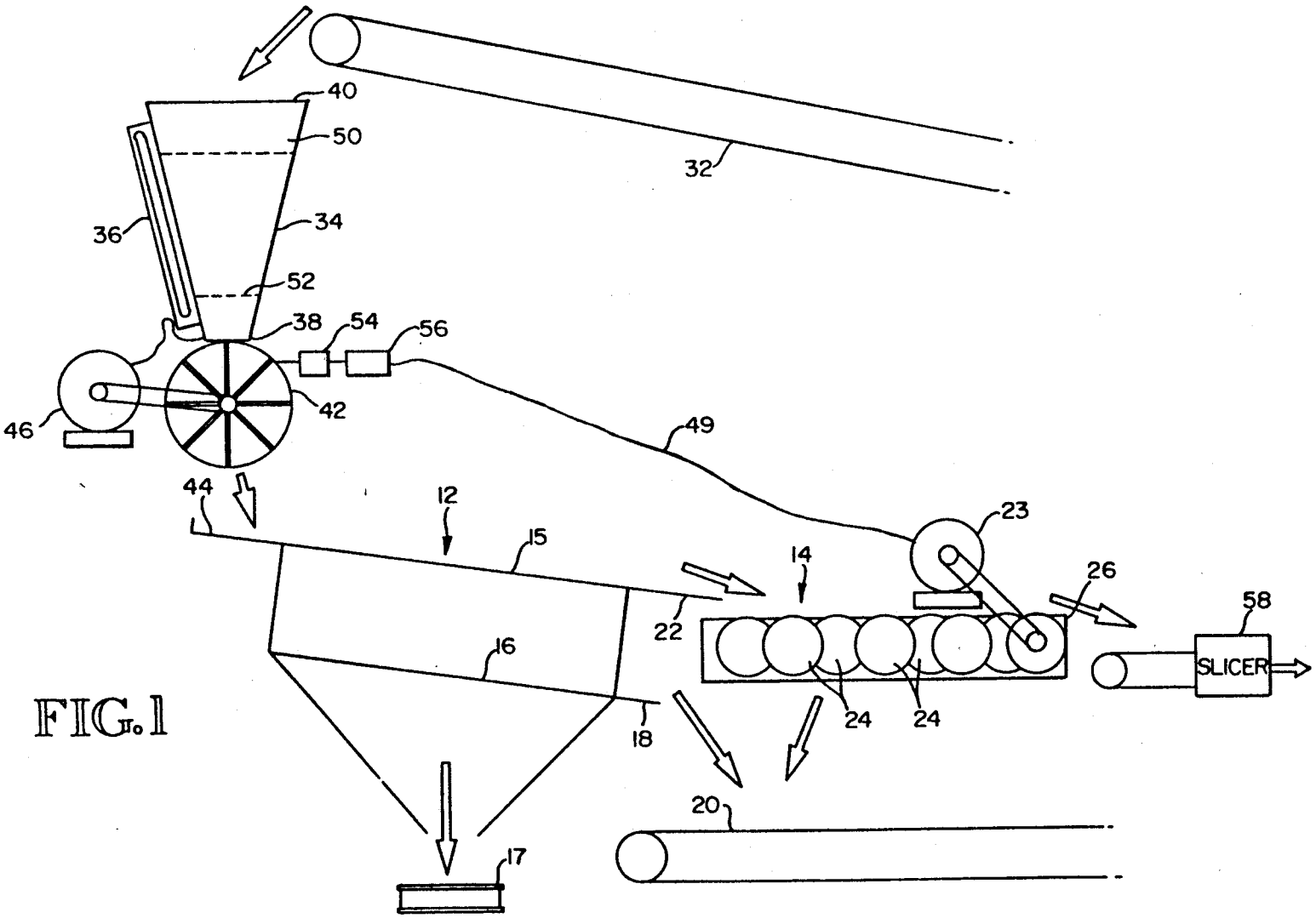

The figure shows generally a screening system for wood chips which includes both a gyratory screen 12 and a disk screen 14. In the embodiment shown, both gyratory screen 12 and disk screen 14 are conventional, and are combined in conventional fashion. Gyratory screen 12 may include a number of different screens or decks to produce several chip separations based on size. Typically, each screen or deck includes a flat sheet member which has openings of a selected size and configuration, depending upon the application. In operation, those chips within an acceptable predetermined size range (referred to as accepts) fall through the successive screens until the screen is reached which holds them. The gyratory screen system 12 shown in the figure includes a primary or top screen 15, and a secondary screen shown generally at 16, with the accepts remaining on top of the secondary screen 16 and the chips which fall through the secondary screen 16 typically being below the acceptable size range, referred to as fines or "unders".

The fines material are typically directed on a conveyor or the like to a location where they undergo further processing. The acceptable size chips, which remain on top of the secondary screen 16, move off the downstream end 18 of secondary screen 16 to a conveyor 20 or the like, which transports the accepts to a storage facility or to a digester for further chip processing.

Those chips which remain on the primary screen 15 are a combination of oversize chips and a small amount of chips within the acceptable size range. Those chips are moved off the downstream end 22 of primary screen 12 to disk screen 14.

Disk screen 14 generally comprises a plurality of rotating disks 24—24 which are mounted on shafts which extend across the disk screen. The disks are spaced apart a selected distance on said shafts so as to pass chips having a size within the acceptable range. In operation, acceptable size chips pass through disk screen 14 onto conveyor 20. The disk screen 14 is driven by a motor 23. Oversize chips pass off the outflow end 26 of disk screen 14, from where they are moved to a size reduction device such as a chip slicer 58 or the like. After the size of the chips has been reduced, they are then either applied directly to the conveyor 20, or reprocessed through the system.

Again, the above briefly described combination is conventional in structure and operation. A more detailed explanation of such a system is provided in U.S. Pat. No. 5,000,390, to Gevan R. Marrs, and owned by the same assignee as the present invention.

As indicated above, in operation of a combined gyratory/disk screen system, the mass flow rate off the outflow end 26 of disk screen 14 is uneven, due to differences in the rate and characteristics of the input. In some cases, the mass flow rate off the disk screen is great enough to cause a back-up or even plugging of the chip slicer. If this occurs, the entire system must be shut down in order to correct the problem. This significantly impairs the overall efficiency and performance of the system, and therefore is quite undesirable.

The system of the present invention uses information obtained from the existing conventional combined system in order to provide a variable speed control for the disk screen. In a conventional system, wood chips or the like are loaded on a conventional input conveyor system shown representationally at 32. Conveyor 32 can, of course, take various configurations and sizes depending upon the application. Conveyor 32 moves the input wood chips to a feeder surge bin shown generally at 34 which has associated therewith a sensing device 36, which senses the level of chips in the bin. Typically, surge bin 34 will be somewhat cone-shaped, narrower at the lower end 38 thereof relative to the upper end 40, so as to encourage movement of the chips downwardly out of bin 34.

Immediately below the lower end 38 of bin 34 is a conventional star feeder valve 42 which, in operation, receives input material from bin 34 and deposits it on the input end 44 of gyratory screen 12. Both surge bin 34 and star feeder valve 12 are conventional and hence, are not described in detail herein. Star feeder valve 42 is, in operation, driven by a variable speed drive motor 46 which in turn is controlled by level-sensing device 36. Basically, sensor 36 attempts to maintain the level of material in the bin between selected high and low set points shown diagramatically at 50 and 52 in the figure. The input flow from conveyor 32 will be variable due to the lack of control over the placement of chips onto conveyor 32, and/or the unpredictable movement of the chips while on conveyor 32. The input of wood chips into the surge bin 34 will thus vary in an unpredictable manner; hence, the star feeder valve motor 46 will operate at unpredictable, i.e. variable, speeds in order to maintain the level of material in surge bin 34 between the two set points 50 and 52.

In the present invention, star feeder valve 42 is used to develop an electrical control signal which is fed back to the disk screen drive motor 23, which in the present invention is a variable speed motor. For instance, as the speed of the star feeder valve 42 increases, which controls the amount of chip input to the gyratory screen 12 and ultimately the amount of chip input to the infeed end of disk screen 14, this increase is sensed by a sensor shown at 54, the output signal from which is applied to a control unit 56, which in turn produces a signal on line 49 to reduce the speed of motor 23 to ensure sufficient processing time for the amount of input applied to the disk screen 14. While in one embodiment it is the speed of the star feeder valve itself which is sensed, the speed of motor 46 can also be used. On the other hand, as the speed of star feeder valve 42 is reduced, thereby reducing the input to the gyratory screen and hence the amount of input to be applied to the infeed end of disk screen 14, the speed of motor 23 and hence disk screen 14 is increased. This system results in a substantially uniform flow rate off the downstream end of the disk screen so that in turn the chip slicer 58 has a uniform input or load over time. This has the desirable effect of minimizing the potential for plugging of the chip slicer, while at the same time maximizing the amount of overthick chips removed under all loading conditions.

An alternative to using a control signal from motor 46 or star feeder valve 42 is the signal from the bin level sensing device 36, which also controls the speed of star feeder valve motor 46. The respective signals are proportional, so that the ultimate control results are the same.

Hence, the disk screen in the present invention has a variable speed capability using existing signals from the conventional combined system, to produce in operation a mass flow rate off the disk screen 14 which is substantially uniform, even with a significant range in the rate of material applied to the gyratory screen. Such a system has been found not only to reduce the potential for plugging of the chip slicer, but also enables the system to be set for an optimum overthick removal efficiency, without negatively affecting the ACO characteristic, leading to an improvement in overall system performance.

Although a preferred embodiment of the invention has been disclosed herein for illustration, it should be understood that various changes, modifications and substitutions may be incorporated in such embodiment without departing from the spirit of the invention which is defined by the claims which follow:

What is claimed is:

1. A system for control of the rate of overflow from a disk screen portion of a combination screening system, comprising:

a screening system which includes a first screen assembly, a following disk screen assembly, and a feeder assembly at an input end of said first screen assembly, said feeder assembly adapted to receive input material from a source thereof and including a drive means which in operation provides a variable rate of input material to the input end of said first screen assembly; and control means responsive to the operation of said feeder assembly for variably controlling the speed of said disk screen.

2. A system of claim 1, wherein the speed of said disk screen is controlled so that the flow rate of material off said disk screen is substantially uniform during operation thereof.

3. A system of claim 1, wherein the speed of said disk screen is proportional to the speed of said drive means and hence is proportional to the rate of input material provided to said first screen assembly.

4. A system of claim 1, wherein the feeder assembly includes an input material conveyor having in operation a variable amount of input material thereon, a storage bin for receiving the input material from the conveyor, a star valve, driven by said drive means, for delivering input material from the storage bin to the first screen assembly, and a level sensor for determining the level of input material in the storage bin, wherein the star valve in operation is controlled so that the level of input material in the storage bin is maintained between two selected set points.

5. A system of claim 3, wherein the drive means includes a first variable speed motor responsive to the level sensor for driving the star valve and wherein the control means includes a second variable speed motor for driving said disk screen, wherein said second variable speed motor is responsive to the first variable speed motor.

6. A system of claim 1, wherein the first screen assembly is a gyratory screen.

7. In a system for control of the rate of overflow from a disk screen portion of a combination screening system which includes a first screen assembly, a following disk screen assembly, and a feeder assembly at an input end of the said first screen assembly, wherein said feeder assembly is adapted to receive input material from a source thereof and includes a drive means which in operation provides a variable input rate of material to the input end of said first screen assembly, the improvement comprising:

control means responsive to said feeder assembly for variably controlling the speed of said disk screen.

8. A system of claim 7, wherein the speed of the disk screen is controlled so that the flow rate of material off said disk screen is substantially uniform during operation thereof.

9. A system of claim 7, wherein the speed of said disk screen is proportional to the speed of said drive means and hence is proportional to the rate of input material provided to said first screen assembly.

10. A system of claim 7, wherein the control means includes a variable speed motor for driving said disk screen.

* * * * *